US005836005A

United States Patent [19]

Chang

[11] Patent Number: 5,836,005

[45] Date of Patent: Nov. 10, 1998

[54] MOBILE TELEPHONE ANTENNA

[75] Inventor: Daniel Chang, Tao-Yuan Hsien, Taiwan

[73] Assignee: Auden Technology Mfg.Co. Ltd., Taiwan

[21] Appl. No.: 736,086

[22] Filed: Oct. 24, 1996

[51] Int. Cl.[6] ..... H01Q 1/24

[52] U.S. Cl. ..... 343/702; 343/895; 343/901

[58] Field of Search ..... 343/702, 895, 343/745, 749, 752, 901; H01Q 1/24

[56] References Cited

U.S. PATENT DOCUMENTS

| | | | |
|---|---|---|---|
| 5,177,492 | 1/1993 | Tomura et al. | 343/702 |
| 5,426,440 | 6/1995 | Shimada et al. | 343/702 |
| 5,606,327 | 2/1997 | Elliott et al. | 343/702 |

*Primary Examiner*—Hoanganh T. Le
*Attorney, Agent, or Firm*—Bacon & Thomas

[57] ABSTRACT

A mobile telephone antenna including an alloy wire rod moved in a metal socket in a mobile telephone at the top, the alloy wire rod having a bottom end fixed with a first axial metal element, and a top end inserted through a second axial metal element, which is mounted in a stepped locating member inside an antenna cap, an insulative sleeve mounted around the top section of the stepped locating member and defining a space on the inside above the top section of the stepped locating member, a matching coil mounted around the stepped locating member and the insulative sleeve and stopped between the bottom section of the stepped antenna and the inside wall of the antenna cap, and a contact terminal fixedly fastened to the top end of the alloy wire rod and moved in the space between a first position in which the antenna terminal disposed in contact with the second axial metal element and the stepped locating member and the mobile telephone antenna is collapsed, and a second position in which the antenna terminal is disconnected from said second axial metal element and the stepped locating member and the mobile telephone antenna is extended out.

2 Claims, 6 Drawing Sheets

MOBILE TELEPHONE ANTENNA

BACKGROUND OF THE INVENTION

The present invention relates to mobile telephone antennas, and more particularly to such a mobile telephone antenna which eliminates the interference of outside noise when extended out.

Mobile telephones have been more and more popularly used for the advantage of high mobility. A mobile telephone is generally equipped with a retractable antenna for receiving radio signal. When in use, the retractable antenna is extended out to receive radio signal. When the retractable antenna is extended out, the metal contact bushing of the mobile telephone antenna is disconnected from the metal socket in the mobile telephone, and radio signal transmission between the metal contact bushing of the retractable antenna and the metal socket is achieved by means of the induction of a matching element at the top of the retractable antenna. This signal transmission method tends to be interfered by outside noises.

SUMMARY OF THE INVENTION

The present invention has been accomplished to provide a mobile telephone antenna which eliminates the aforesaid problem. According to one aspect of the present invention, the mobile telephone antenna is mounted in a metal socket in a mobile telephone, comprising an alloy wire rod inserted through the socket and having a bottom end and a top end, a first axial metal element fixedly fastened to the bottom end of the alloy wire rod, an antenna cap, a stepped locating member fixedly mounted inside the antenna cap around the top end of the alloy wire rod, the stepped locating member comprising bottom section, a middle section, and a top section, the diameter of the middle section being bigger than the top section and smaller than the bottom section, an insulative sleeve mounted around the top section of the stepped locating member and defining a space on the inside above the top section of the stepped locating member, a matching coil mounted around the middle section of the stepped locating member and the insulative sleeve within the antenna cap and retained between the stepped locating member and the antenna cap, and a contact terminal fixedly fastened to the top end of the alloy wire rod and moved in the space between a first position in which the antenna terminal disposed in contact with the second axial metal element and the stepped locating member, and a second position in which the antenna terminal is disconnected from said second axial metal element and the stepped locating member.

DETAILED DESCRIPTION OF THE DRAWINGS

DETAILED DESCRIPTION OF THE PREFERRED EMBODIMENT

Figure 1:
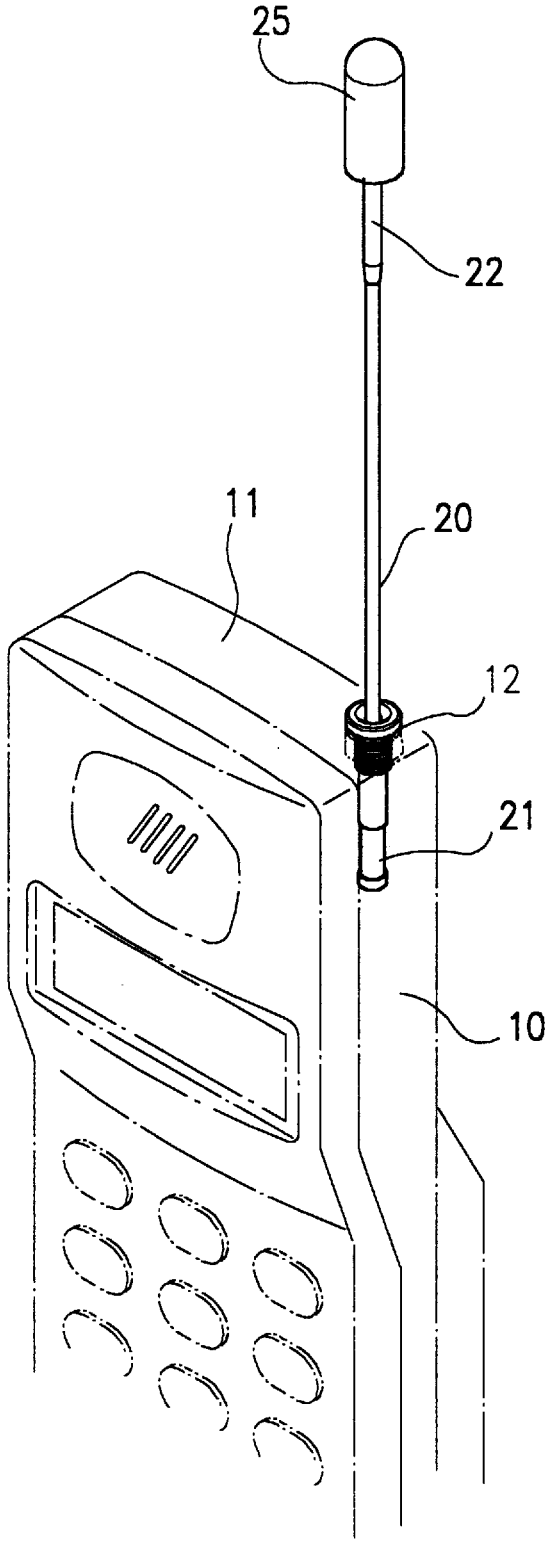
FIG. 1 shows a mobile telephone antenna installed in a mobile telephone and extended out according to the present invention.

Referring to FIG. 1, the mobile telephone antenna of the present invention is mounted in a metal socket 12 at the top side 11 of the mobile telephone 10 in one corner.

Figure 2:
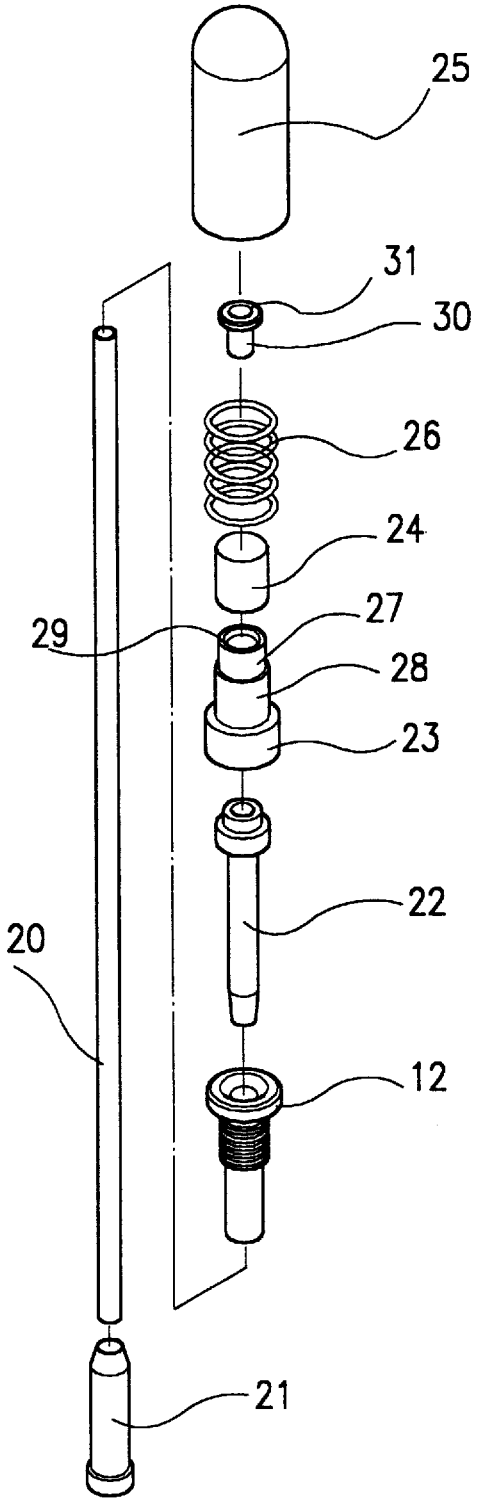
FIG. 2 is an exploded view of the mobile telephone antenna shown in FIG. 1.

Referring to FIG. 2, the mobile telephone antenna comprises an alloy wire rod 20. The alloy wire rod 20 has a bottom end fixedly mounted with a first axial metal element 21, and a top end inserted in proper order through the metal socket 12, a second axial metal element 22 and a stepped locating member 23. An insulative sleeve 24 is mounted around the stepped locating member 23. An antenna cap 25 is covered on the stepped locating member 23 and the insulative sleeve 24. A matching coil 26 is mounted within the antenna cap 25 and retained between the inside wall of the antenna cap 25 and the stepped locating member 23.

Figure 3:
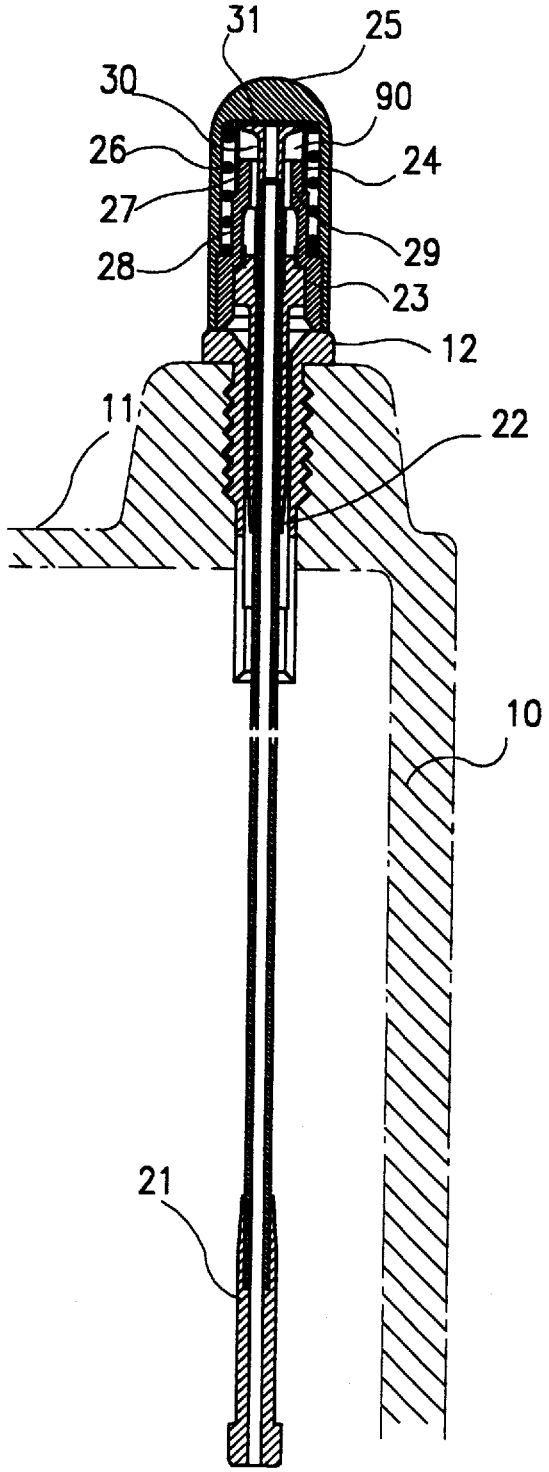
FIG. 3 is a sectional view of the mobile telephone antenna shown in FIG. 1 when collapsed.

Referring to FIGS. 2 and 3, the insulative sleeve 24 is mounted around the top section 27 of the locating member 23. The metal coil 26 is mounted around the middle section 28 of the locating member 23 and the insulative sleeve 24. The longitudinal length of the insulative sleeve 24 is longer than the top section 27 of the locating member 23. When the insulative sleeve 24 is installed, a space 90 is defined within the insulative sleeve 24 above the top section 27 of the locating member 23.

When the top end of the alloy wire rod 20 is inserted through the second axial metal element 22 into the axial through hole 29 of the locating member 23, a contact terminal 30 is fastened to the top end of the alloy wire rod 20. The contact terminal 30 has a head 31 disposed outside the top section 27 of the locating member 23 within the space 90.

Referring to FIG. 3, when the mobile telephone antenna is collapsed, the second axial metal element 22 and the bottom side of the locating member 23 are disposed in contact with the metal socket 12, the contact terminal 30 is disconnected from the second axial metal element 22 and the locating member 23, and therefore radio signal is directly received by the metal socket 12.

Figure 4:
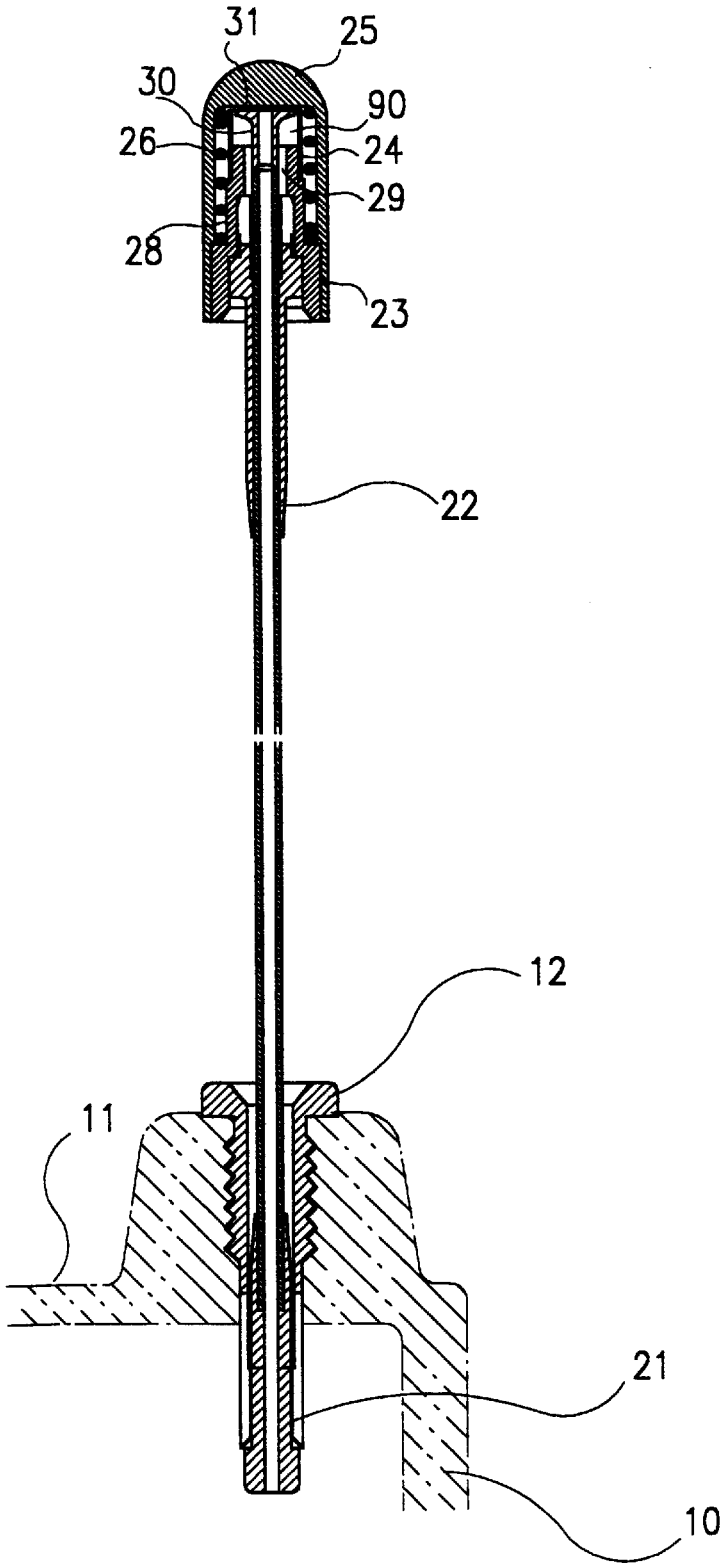
FIG. 4 is similar to FIG. 3 but showing the mobile telephone antenna pulled.
Figure 5:
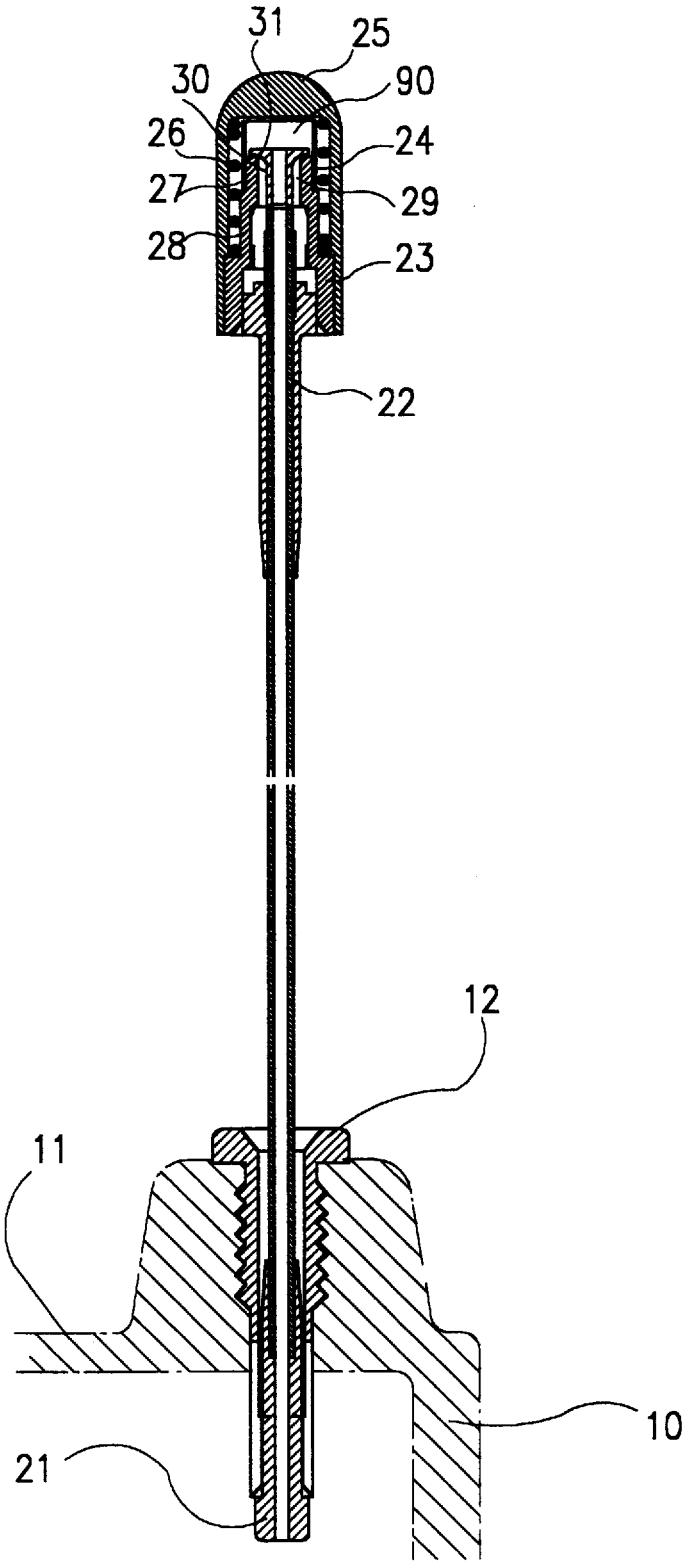
FIG. 5 is similar to FIG. 4 but showing the mobile telephone antenna fully extended out; and, FIG. 6 is a sectional view of an alternate form of the present invention.

Referring to FIGS. 4 and 5, when the antenna cap 25 is pulled outwards from the mobile telephone 10, the alloy wire rod 20 is extended outwards from the metal socket 12 (see FIG. 4).

When the alloy wire rod 20 is completely extended out, the head 31 of the contact terminal 30 is forced into contact with the top side of the locating member 23 to receive radio signal directly.

Figure 6:
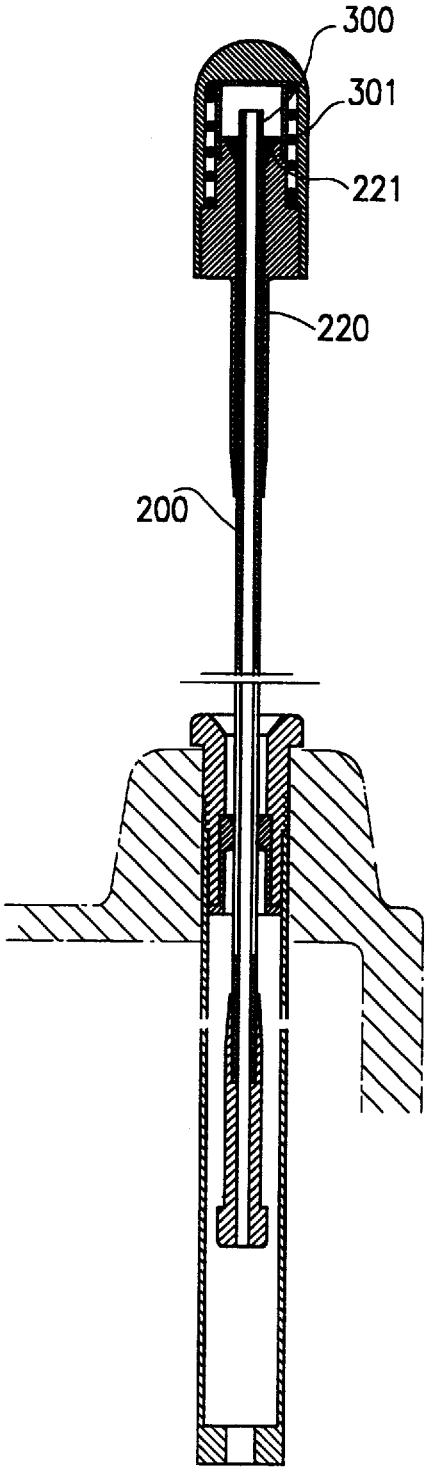

FIG. 6 shows an alternate form of the present invention, in which the contact terminal 300 which is fastened to the top end of the alloy wire rod 200 has a bottom cone 301 narrowing towards the bottom side; the second axial metal element 220 and the locating member 23 have a respective tapered top hole 221 adapted for receiving the bottom cone 301 of the contact terminal 300.

It is to be understood that the drawings are designed for purposes of illustration only, and are not intended as a definition of the limits and scope of the invention disclosed.

What the invention claimed is:

1. A mobile telephone antenna mounted in a metal socket at a top side of a mobile telephone, comprising an alloy wire rod inserted through said metal socket and having a bottom end and a top end, said bottom end being fixedly fastened to a first axial metal element and said top end being inserted through a second axial metal element, an antenna cap, a stepped locating member fixedly mounted inside said antenna cap around the top end of said alloy wire rod, said stepped locating member comprising bottom section, a middle section, and a top section, the diameter of said middle section being bigger than said top section and smaller than said bottom section, an insulative sleeve mounted around the top section of said stepped locating member and defining a space on the inside above the top section of said stepped locating member, a matching coil mounted around the middle section of said stepped locating member and said insulative sleeve within said antenna cap and retained between said stepped locating member and said antenna cap, and a contact terminal having a head disposed outside the top section of said stepped locating member, said contact terminal being fixedly fastened to the top end of said alloy wire rod and moved in said space between a first position in which said head of said contact terminal is disposed in contact with the top side of said stepped locating member when said mobile telephone antenna is fully extended, and a second position in which said head of said contact terminal is disconnected from said second axial metal element and said stepped locating member when the mobile telephone antenna is collapsed and also when the mobile telephone antenna is collapsed said second axial metal element and said bottom side of said locating member are disposed in contact with said metal socket whereby a radio signal is directly received by said metal socket when said antenna is collapsed and said locating member receives a radio signal directly when said antenna is fully extended.

2. A mobile telephone antenna mounted in a metal socket at a top side of a mobile telephone, comprising an alloy wire rod inserted through said metal socket and having a bottom end and a top end, said bottom end being fixedly fastened to a first axial metal element and said top end being inserted through a second axial metal element, an antenna cap, a stepped locating member fixedly mounted inside said antenna cap around the top end of said alloy wire rod, said stepped locating member comprising bottom section, a middle section, and a top section, the diameter of said middle section being bigger than said top section and smaller than said bottom section, an insulative sleeve mounted around the top section of said stepped locating member and defining a space on the inside above the top section of said stepped locating member, a matching coil mounted around the middle section of said stepped locating member and said insulative sleeve within said antenna cap and retained between said stepped locating member and said antenna cap, and a contact terminal having a bottom cone narrowing toward said stepped locating member and said stepped locating member having a respective tapered top hole adapted for receiving the bottom cone of said contact terminal, said contact terminal being fixedly fastened to the top end of said alloy wire rod and moved in said space between a first position in which said bottom cone of said contact terminal is disposed in contact with said tapered top hole of said stepped locating member when said mobile telephone antenna is fully extended, and a second position in which said bottom cone of said contact terminal is disconnected from said second axial metal element and said stepped locating member when the mobile telephone antenna is collapsed and also when the mobile telephone antenna is collapsed said second axial metal element and said bottom side of said locating member are disposed in contact with said metal socket whereby a radio signal is directly received by said metal socket when said antenna is collapsed and said locating member receives a radio signal directly when said antenna is fully extended.

* * * * *